US006447825B1

(12) United States Patent
Korsten

(10) Patent No.: US 6,447,825 B1
(45) Date of Patent: Sep. 10, 2002

(54) INSTANT MENU PACK AND METHOD FOR PRODUCING IT AND MAKING IT READY FOR USE

(75) Inventor: Gerd Korsten, Bad Mergentheim (DE)

(73) Assignee: Hofmann-Menu Holding GmbH, Boxberg (DE)

( * ) Notice: Subject to any disclaimer, the term of this patent is extended or adjusted under 35 U.S.C. 154(b) by 0 days.

(21) Appl. No.: 09/530,610

(22) PCT Filed: Jul. 14, 1998

(86) PCT No.: PCT/EP98/04365

§ 371 (c)(1),
(2), (4) Date: Aug. 14, 2000

(87) PCT Pub. No.: WO99/23013

PCT Pub. Date: May 14, 1999

(30) Foreign Application Priority Data

Oct. 31, 1997 (DE) ..... 197 48 307

(51) Int. Cl.[7] ..... B65D 81/34; B65B 29/08

(52) U.S. Cl. ..... 426/115; 426/90; 426/107; 426/113; 426/106; 426/234; 426/243; 426/393; 426/394

(58) Field of Search ..... 426/113, 120, 426/107, 114, 234, 243, 90, 393, 106, 115, 394

(56) References Cited

U.S. PATENT DOCUMENTS 2,768,086 A 10/1956 Bliley
3,031,309 A * 4/1962 Bogner et al. ..... 426/113

(List continued on next page.)

FOREIGN PATENT DOCUMENTS

DE 91 05 684.5 8/1991
EP 0 409 289 1/1991

(List continued on next page.)

*Primary Examiner*—Steve Weinstein
(74) *Attorney, Agent, or Firm*—Knobbe, Martens, Olson & Bear, LLP

(57) ABSTRACT

Instant menu pack having a substantially tray-like base part, whose circumferential side wall diverges outwards from a substantially flat bottom towards the upper edge thereof and passes there into an outwardly projecting, substantially flat, bottom-parallel, circumferential marginal flange, an instant menu filled into the base part having at least two components with a different consistency, which is preferably pre-cooked and deep-freezable after filling into the base part, and a sealing foil sealed onto the marginal flange after filling the instant menu, characterized in that the base part is made from a material permeable to microwave energy and which can absorb water at least in its surface layer facing the instant menu and whose thermal expansion coefficient in the temperature range between −20° C. and room temperature is lower than that of the instant menu, that the marginal flange is given a flexible-deformable construction in such a way that following the removal of the sealing foil it engages relatively closely on a circumferential opposite face, which is substantially parallel to the marginal flange, such as the rim of a plate or the like, that between the level of the instant menu remote from the bottom and the inner face of the sealing foil facing the bottom is left a functional space, and that the components of the instant menu are filled into the base part in a layer arrangement perpendicular to the bottom in such a way that the individual layers have an order opposite to the intended order of the individual components on consumption, as well as method for producing and making ready for use such an instant menu pack.

7 Claims, 1 Drawing Sheet

U.S. PATENT DOCUMENTS

| | | | | | |
|---|---|---|---|---|---|
| 3,240,610 | A | * | 3/1966 | Cease | 426/113 |
| 3,244,537 | A | * | 4/1966 | Cease | 426/113 |
| 3,610,458 | A | * | 10/1971 | Nissley | 426/120 |
| 3,681,094 | A | * | 8/1972 | Rogers et al. | 426/113 |
| 4,133,896 | A | * | 1/1979 | Standing et al. | 426/113 |
| 4,328,254 | A | * | 5/1982 | Waldburger | 426/87 |
| 4,574,174 | A | | 3/1986 | McGonigle | |
| 4,590,349 | A | * | 5/1986 | Brown et al. | 426/113 |
| 4,777,053 | A | * | 10/1988 | Tobelmann et al. | 426/113 |
| 5,045,333 | A | * | 9/1991 | Petrofsky | 426/113 |

FOREIGN PATENT DOCUMENTS

| | | | | |
|---|---|---|---|---|
| EP | 0 437 082 | | 7/1991 | |
| GB | 1172377 | * | 11/1969 | 426/114 |
| GB | 1257896 | * | 12/1971 | 426/113 |
| JP | 7031397 | | 2/1995 | |

* cited by examiner

INSTANT MENU PACK AND METHOD FOR PRODUCING IT AND MAKING IT READY FOR USE

FIELD OF THE INVENTION

The invention relates to an instant menu pack and to a method for producing and making ready for use such an instant menu pack.

BACKGROUND OF THE INVENTION

In the case of instant menu packs of the aforementioned type the base part is conventionally made from deep-drawn aluminium foil, whilst the sealing foil can also be made from aluminium or also coated plastics material or the like. The heating of such instant menu packs where, after filling the instant menu in the base part and applying the sealing foil, deep freezing takes place and the instant menu pack is then stored at a maximum of −18° C., generally takes place in a circulating air oven or the like and for after-cooking the instant menu which has only been pre-cooked prior to filling into the base part, a time of approximately 40 minutes is generally necessary.

The known instant menu pack has proved substantially satisfactory, but it is occasionally considered to be disadvantageous that in the case where certain components of the instant menu are e.g. liquid, on filling into the base part, which i.e. takes place in an order ensuring that during the subsequent consumption the last-filled upper layer is at the top and can firstly be consumed, the trickling of liquid components into the underlying layers, e.g. of sauces, can only be prevented in that the base part is subdivided into different compartments, so that then the user subsequently applies from a specific base part compartment the sauce or the like to the solid component and can consequently bring about pleasing consumption characteristics. The aforementioned problem e.g. more particularly arises with a spaghetti dish, which is to be covered with a tomato-based sauce and subsequently with a Parmesan cheese layer.

Quite apart from the fact that instant menu packs of the aforementioned type cannot be heated by microwave energy, because the aluminium foil lower part is not permeable to microwave energy, the aforementioned disadvantages can also not be avoided when the lower part is made from a microwave energy-permeable material, because even then prior to the deep-freezing process, there is a trickling of e.g. liquid sauce components into the underlying solid layers of the instant menu, said effect being further intensified on warming up by microwave energy. In addition, microwave heating of instant menus has generally hitherto suffered from the disadvantage that it is impossible to cross surface layers, so that it is very difficult to give pleasing consumption characteristics to pizzas or meat dishes in the case of microwave heating. (DE 91 05 684 U1 discloses an instant menu pack in which the layer order of the food prior to preparation or cooking is different from that in the ready-to-eat state, because after heating the, pack container provided with the deep-frozen food located therein in the delivery state, the layer-like constituents of the heated food are rearranged prior to consumption. No a reference is made to the problem of avoiding the trickling of liquid sauce components, etc. into the solid layers of an instant menu.

SUMMARY OF THE INVENTIONS

The problem of the invention is to improve the aforementioned instant menu pack in that on the one hand an undesired mixing of the individual components without subdividing the base part into different compartment is avoided and on the other the obtaining of corresponding consumption characteristics is ensured, even with microwave heating. The invention also provides a method for producing and making ready for use such an instant menu pack.

An aspect of the invention involves an instant menu pack having a substantially tray-like base part, an instant menu and a sealing foil. The instant menu has at least two components with a different consistency and is pre-cooked and deep-freezable. The substantially tray-like base part receives the instant menu and has a circumferential side wall that diverges outwards from a substantially flat bottom towards an upper edge thereof where it passes into an outwardly projecting, substantially flat, bottom-parallel, circumferential marginal flange. The base part is made from a material permeable to microwave energy and can absorb water at least in a surface layer facing the instant menu. The material has a thermal expansion coefficient in a temperature range between −20° C. and room temperature that is lower than a thermal expansion coefficient of the instant menu. The components of the instant menu are filled into the base part in a layer arrangement perpendicular to the bottom in such a way that the individual layers have an order opposite to the intended order of the individual components on consumption. The sealing foil is sealed onto the marginal flange after filling the instant menu. The marginal flange has a flexible-deformable construction so that, following the removal of the sealing foil, it engages closely on a circumferential opposite face, which is substantially parallel to the marginal flange such as the rim of a plate. Between a level of the instant menu remote from the bottom and an inner surface of the sealing foil facing the bottom a functional space exists.

In preferred embodiments of the instant menu pack, the functional space has a height that corresponds to at least ¼, or approximately ⅓, of a height of the filled instant menu, and the base part may be substantially circular and made from a plastics material provided on an inside facing the instant menu with a water-absorbing coating. The base part may also be made from shaped cardboard or shaped carton of the instant menu pack according to claim 1 form the subject matter of subclaims 2 to 6.

Another aspect of the invention involves a method for producing and making ready for use an instant menu pack. Components of an instant menu are introduced into a base part at room temperature or a pre-cooking temperature, successively and in an order which is reverse to an order of consuming the instant menu. The instant menu is deep frozen and a sealing foil is sealed onto a marginal flange of the base part. At the end of a deep-freeze storage and prior to heating the instant menu for consumption the sealing foil is removed from the marginal flange. The base part with the instant menu located therein is inverted and placed onto a plate, wherein under an influence of gravity the instant menu detaches from a lower part of the base part that is supported as a cover on a rim of the plate, and wherein between the instant menu and an inner surface of the lower part a cooking area is formed that is bounded by a bottom of the lower part and part of a side wall of the base part. The instant menu is heated and, prior to consumption, the lower part is lifted off the plate so that the instant menu is exposed for consumption.

In one embodiment, the instant menu may be heated by microwave energy. Further, a plate used for inverting the base part with the instant menu located therein has an external diameter is at least slightly larger than an internal diameter of the marginal flange of the base part.

The invention is based on the surprising finding that it is possible to solve the above problem and eliminate the disadvantages of the hitherto known instant menu packs in that the individual components of the instant menu are filled into a lower part not subdivided into compartments in the form of vertically succeeding layers in an order ensuring that the layer at the top during subsequent consumption is introduced first and the bottom layer or component for subsequent consumption is introduced last. This e.g. makes it possible to fill a spaghetti dish with sauce layer and Parmesan layer without any undesirable mixing of the individual components.

In the lower part there remains an upper functional area, which together with the fact that the thermal expansion coefficient of the material from which the lower part is made is lower than that of the instant menu, ensures that on inverting the deep-frozen instant menu pack onto a plate or the like, the instant menu is detached from the lower part now serving as a cover and drops onto the plate and between the cover and the instant menu a cooking area is formed, which is relatively tightly sealed to the outside by the marginal flange of the lower part supported on the plate rim. If the instant menu is now rapidly heated by microwave energy, where in this case only about four minutes are needed for heating and after-cooking, compared with the roughly 40 minutes when heating up conventional instant menus of the aforementioned type in a circulating air oven or the like, the sauce which is at the top, i.e. in the presently described example above the spaghetti layer, only trickles into the latter to such an extent that pleasing consumption characteristics are acquired and e.g. a Parmesan layer located above the sauce layer in the consumption position is crossed.

The instant menu pack according to the invention is eminently suitable for the preparation of "difficult" instant menus, in which particular importance is attached to the separation of the different components of the instant menu until immediately prior to consumption and in particular makes it possible as a result of the cover remaining on the plate or the like, to transport the finished menu following heating in a central kitchen, e.g. of a hospital or the like, in the covered state to the sick bed and only there remove the cover, so that not only is the instant menu protected against contamination, but also an undesirable cooling between heating and consumption is avoided.

BRIEF DESCRIPTION OF THE DRAWINGS

Further features and advantages of the invention can be gathered from the following description of an embodiment relative to the attached drawings, wherein show.

DETAILED DESCRIPTION OF THE INVENTION

Figure 1:
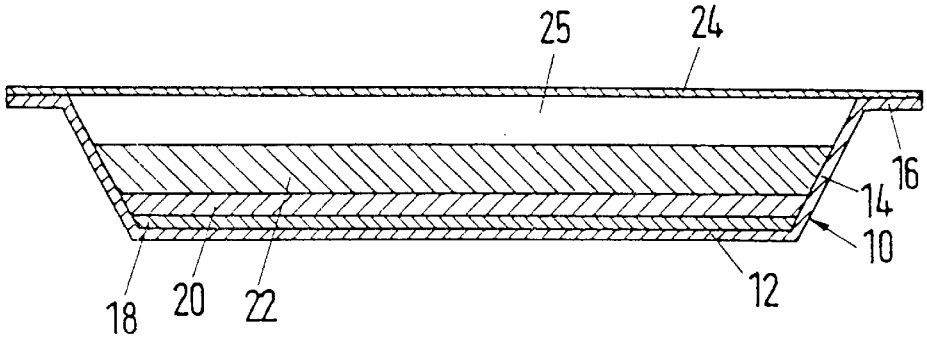
FIG. 1 An embodiment of an instant menu pack according to the invention in the transportation state and in section through the normally perpendicular median longitudinal axis.

As can be seen in FIG. 1, the instant menu pack in the embodiment shown therein has a tray-like base part 10, which is produced by press punching cardboard. The base part 10 has a substantially flat bottom 12 and a circumferential side wall 14 upwardly diverging in sloping manner therefrom in FIG. 1 and to which is connected an also circumferential marginal flange 16, which is substantially flat and substantially parallel to the bottom 12. It is particularly important that as a result of the material selection the marginal flange 16 is substantially flexible-deformable and optionally for this purpose, other than in the embodiment shown in FIG. 1, the marginal flange 16 can be made thinner than the bottom 12 and/or the side wall 14 of the base part 10.

At least on its surface inwardly bounding the resulting tray, the base part 10 does not have a water-repelling treatment, but is instead constructed in water vapour-absorbing manner throughout.

Engaging on the bottom 12, in the base part 10 are provided in succeeding manner a Parmesan layer 18, a tomato-based sauce layer 20 and a spaghetti layer 22. Onto the marginal flange 16 is sealed a coated aluminium sealing foil 24 and between the inner face of the sealing foil 24 facing the bottom 12 and the level of the spaghetti layer 22 remote from the bottom 12 is left a functional space 25, which in the embodiment shown has a height in the direction of the perpendicular representing approximately ⅓ of the spacing between the upper bearing surface of the bottom 12 and the level of the spaghetti layer 22.

Figure 2:
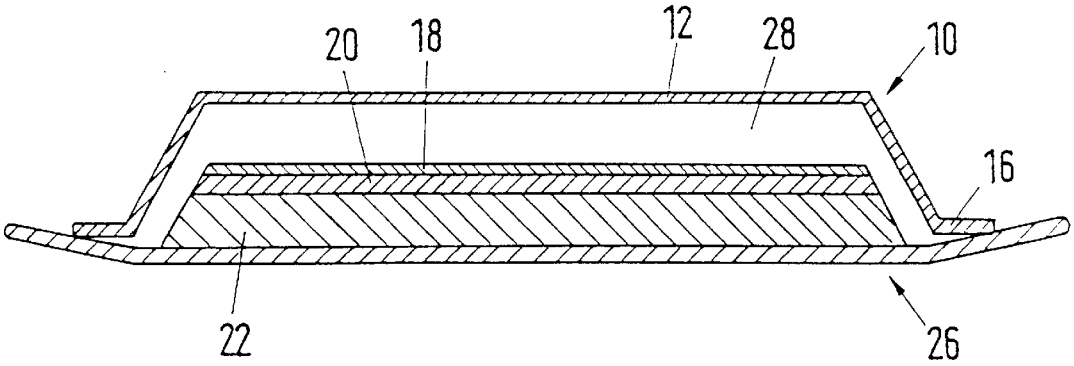
FIG. 2 The instant menu pack of FIG. 1 after removing the sealing foil and inverting onto a plate in the warming up position.

Whilst omitting the sealing foil 24 shown in FIG. 1, in FIG. 2 the base part 10 is in the inverted position on a circular plate 26, the marginal flange 16 of the base part 10 resting in closely engaging manner on the plate rim and the spaghetti layer 22 resting on the bearing surface of the plate 26. Between the upper face of the now top Parmesan layer 18 and the inner face of the now top bottom 12 of the base part 10 is formed a cooking area 28.

In the method according to the invention, the instant menu pack is produced and made ready for use in the form according to FIGS. 1 and 2 in the following way:

In the position shown in FIG. 1, in which the bottom 12 of the base part 10 rests on a substrate, such as e.g. a conveyor belt or the like, the base part 10 is filled with the individual components of the instant menu in such a way that the component which is to be at the top after heating, i.e. in the use position, is filled first and that which is filled last is the component which is to be at the bottom when consuming the instant menu. Thus, into the base part 10 is firstly filled the Parmesan layer 18, then the sauce layer 20 and only then the spaghetti layer 22. Filling takes place at the room or pre-cooking temperature of the individual components and which are consequently not completely cooked after filling into the base part 10. Then the sealing foil 24 is sealed onto the marginal flange 16 of the base part 10. The now finished instant menu pack is then deep-frozen, namely to a core temperature of −18° C.

Subsequently during transportation, storage, etc., the instant menu pack is kept below or at the most at said deep-freezing temperature.

If the instant menu is now to be consumed and for which purpose a prior warming up is required, the sealing foil 24 is removed and then, as shown in FIG. 2, the base part 10 freed from the sealing foil and with the instant menu 18, 20, 22 located therein is inverted onto a conventional plate 26. Due to gravity and the functional space 25 left free during the production of the instant menu pack according to FIG. 1 and which is located between the upper level of the spaghetti layer 22 and the sealing foil 24, under the influence of gravity the instant menu comprising the three aforementioned components drops downwards in the manner visible in FIG. 2, a cooking area 28 being formed between the Parmesan layer 18, which is now at the top; and the bottom 12 of the base part 10. To ensure that on inverting the base part 10 with the instant menu 18, 20, 22 located therein onto the plate 26, under the influence of gravity an immediate release of the instant menu 18, 20, 22 from the base part 10 takes place, it is also important that the thermal expansion coefficient of the material from which the base part 10 is made is lower than that of the instant menu 18, 20, 22, so that the latter during deep-freezing shrinks more than the base part 10, so that the instant menu 18, 20, 22 in the transportation position shown in FIG. 1 is located relatively loosely, i.e. with a slight clearance, in the base part 10.

In the warming up position shown in FIG. 2, the marginal flange 16 engages gently on the rim of the plate 26, so that the cooking area 28 is at least sealed with respect to the ambient air to such an extent that the base part 10 in the position shown in FIG. 2 can protect the instant menu 18, 20, 22 against contamination, e.g. until after bringing the heated instant menu to a sick bed or the like, the base part 10 now serving as a cover can be raised from the plate 26.

In the position shown in FIG. 2 the plate 26 with the instant menu 18, 20, 22 located on it and the base part 10, now serving as a cover, is introduced into a microwave oven and then in a period of approximately 4 minutes thawing and final cooking and heating of the instant menu 18, 20, 22 to the consumption temperature take place. Due to the fact that the warming up period is relatively short, it is possible in an ideal manner to ensure that the sauce layer 20 only trickles slightly into the spaghetti layer 22, as is desired for the preparation e.g. in a private kitchen, i.e. in the case of an immediate consumption of the thus prepared spaghetti menu. The Parmesan layer 18 is slightly gratinated, because water vapour passing out of the instant menu is absorbed by the inner face of the base part 10 or is at least partly adsorbed there, so that the cooking area 28 does not have a saturated water vapour atmosphere and is instead relatively "dry", so that there is a gratinating and browning effect on the surface of the Parmesan layer 18. This is not particularly significant with a spaghetti menu, but is of decisive importance when the instant menu is in the form of pizzas, meat cutlets, etc. and then the generally otherwise observed disadvantage of microwave heating, namely not permitting the crossing of surface layers, is avoided as a result of the inventively provided cooking area 28 and the atmosphere set therein.

On terminating the heating of the instant menu 18, 20, 22, the plate 26 is brought to the consumption location and only then is the base part 10 serving as a cover removed and the now ready-to-consume instant menu is consumed.

The features of the invention disclosed in the description, drawings and claims can be essential to different embodiments of the invention, either singly or in random combination.

What is claimed is:

1. An instant menu pack, comprising:

an instant menu having at least two components with a different consistency and being pre-cooked and deep-freezable;

an undivided tray base receiving the instant menu and having a circumferential side wall that diverges outwards from a substantially flat bottom towards an upper edge thereof where it passes into an outwardly projecting, substantially flat, bottom-parallel, circumferential marginal flange, wherein the tray base is made from a material permeable to microwave energy, wherein the tray base comprises a plastic material provided on an inside facing the instant menu with a coating that can absorb water, the material having a thermal expansion coefficient in a temperature range between −20° C. and room temperature that is lower than a thermal expansion coefficient of the instant menu, wherein the components of the instant menu are filled into the tray base in a layer arrangement perpendicular to the bottom in such a way that the individual layers have an order opposite to the intended order of the individual components on consumption; and a sealing foil sealed onto the marginal flange after filling the instant menu, wherein the marginal flange has a flexible-deformable construction so that, following the removal of the sealing foil, it engages closely on a circumferential opposite face, which is substantially parallel to the marginal flange such as the rim of a plate, and wherein between a level of the instant menu remote from the bottom and an inner surface of the sealing foil facing the bottom a functional space exists.

2. The instant menu pack according to claim 1, wherein the functional space has a height that corresponds to at least ¼ of a height of the filled instant menu.

3. The instant menu pack according to claim 2, wherein the height of the functional space is approximately ⅓ of a height of the filled instant menu.

4. The instant menu pack according to claim 1, wherein the tray base is substantially circular.

5. A method for producing and making ready for use an instant menu pack, comprising:

introducing components of an instant menu into an undivided tray base at room temperature or a pre-cooking temperature, successively and in an order which is reverse to an order of consuming the instant menu, wherein the tray base has a circumferential side wall that diverges outwards from a substantially flat bottom towards an upper edge thereof where it passes into an outwardly projecting, substantially flat, bottom-parallel, circumferential marginal flange, wherein the tray base is made from a material permeable to microwave energy, wherein the tray base comprises a plastic material provided on an inside facing the instant menu with a coating that can absorb water, the material having a thermal expansion coefficient in a temperature range between −20° C. and room temperature that is lower than a thermal expansion coefficient of the instant menu; and wherein the marginal flange has a flexible-deformable construction so that upon removing a sealing foil, it engages closely on a circumferential opposite face, which is substantially parallel to the marginal flange such as the rim of a plate;

deep freezing the instant menu;

sealing a sealing foil onto the marginal flange of the tray base, removing the sealing foil from the marginal flange at the end of a deep-freeze storage and prior to heating the instant menu for consumption;

inverting the tray base with the instant menu located therein and placing it onto a plate, wherein under an influence of gravity the instant menu detaches from a lower part of the tray base that is supported as a cover on a rim of the plate, and wherein between the instant menu, and an inner surface of the lower part a cooking area is formed that is bounded by a bottom of the lower part and part of a side wall of the tray base;

heating the instant menu; and prior to consumption lifting the lower part off the plate so that the instant menu is exposed for consumption.

6. The method according to claim 5, wherein the instant menu is heated by microwave energy.

7. The method according to claim 5, wherein for inverting the tray base with the instant menu located therein a plate is used whose external diameter is at least slightly larger than an internal diameter of the marginal flange of the tray base.

* * * * *